United States Patent [19]

Marshall et al.

[11] Patent Number: 4,779,866

[45] Date of Patent: Oct. 25, 1988

[54] PORTABLE FRICTION RESISTANT EXERCISE DEVICE

[75] Inventors: Howard B. Marshall, 301 W. 53rd Street, New York, N.Y. 10019; Gordon E. Kaye, Garrison; Raymond J. Prohaska, East Northport, both of N.Y.

[73] Assignee: Howard B. Marshall, New York, N.Y.

[21] Appl. No.: 60,686

[22] Filed: Jun. 11, 1987

[51] Int. Cl.[4] ..... A63B 21/00

[52] U.S. Cl. ..... 272/132

[58] Field of Search ..... 272/131–133

[56] References Cited

U.S. PATENT DOCUMENTS

| | | | |
|---|---|---|---|
| 518,967 | 5/1894 | Poole | 272/132 |
| 3,640,530 | 2/1972 | Henson et al. | 272/132 |
| 3,929,331 | 12/1975 | Beeding | 272/132 |
| 3,995,853 | 12/1976 | Deluty | 272/132 |
| 4,114,874 | 9/1978 | Mattila | 272/132 |
| 4,484,741 | 11/1984 | Bingisser | 272/131 |

FOREIGN PATENT DOCUMENTS

| | | | |
|---|---|---|---|
| 3311946 | 10/1984 | Fed. Rep. of Germany | 272/132 |
| 2274322 | 1/1976 | France | 272/132 |

*Primary Examiner*—Richard J. Apley
*Assistant Examiner*—J. Welsh
*Attorney, Agent, or Firm*—Lerner, David, Littenberg, Krumholz & Mentlik

[57] ABSTRACT

A portable exercise device for the full and efficient exercise of any group of muscles provides a predetermined and calibrated resistive force established by virtue of friction forces. The exercise device includes, a housing having an integrally formed handle or a receptacle for attaching an accessory connector at one end and an aperture at the end opposite therefrom, a sheave assembly rotatably mounted in the housing having an exercise cord windably retained therearound a moveable handle fixed to the end of the exercise cord which extends through the aperture in the housing, a braking assembly operatively associated with the sheave to frictionally and uni-directionally retard the rotation of the sheave assembly when the exercise cord is forceably unwound from about the sheave assembly, an adjustment dial for adjusting the friction forces acting against the rotation of the sheave assembly, and a spring operatively associated with the sheave assembly rotates the same during operation of the portable exercise device to normally rewind the exercise cord thereabout.

10 Claims, 7 Drawing Sheets

PORTABLE FRICTION RESISTANT EXERCISE DEVICE

BACKGROUND OF THE INVENTION

The present invention relates generally to exercise devices which are portable for use in any setting, and more particularly to a portable exercise device which utilizes frictional forces as opposed to spring or compressive forces to provide the necessary resistance to the unwinding of a coacting exercise cord or other contrivance employed to facilitate in exercising the various muscles of the human body.

Portable exercise devices are well known in the prior art, as is shown by U.S. Pat. Nos. 4,557,480; 4,174,832; 4,114,875; and 3,885,789. These devices all provide rotatable pulleys having a length of cord operatively wound thereabout and provide the necessary resistance to unwinding the exercise cord by either establishing a compressive force against the cord itself or by winding the cord about one or a series of capstands. Such structural limitations give rise to various operational limitations and further cause the exercise cord to wear excessively during the use of the exercise device, thus reducing the efficiency and life of the exercise device. One skilled in the art will readily recognize that the prior art methods of providing resistance to the unwinding of the exercise cord militate against accurate adjustment of the resistance as well as limiting the degree of resistance which can be attained.

The prior art is also deficient in regard to providing a device which can be used effectively when the device is employed independently of a fixed structure. Although a minority of the prior art devices can be used in such a manner, these devices are extremely bulky and difficult to maneuver. An analysis of U.S. Pat. Nos. 4,010,948 and 4,114,875 reveals that a full extension of the muscle being exercised can not be established utilizing the devices disclosed therein because the "fixed" handle is not rigidly secured to the housing containing the exercise cord. Further, a complete program of exercise can not be practiced with the prior art devices because of their size, weight and reduced capabilities when employed independently of a fixed structure.

Thus, it is clear that the shortcomings evident in the prior art warrant improvement with respect to the method of providing resistance to the unwinding of the exercise cord, the compactness and operational maneuverability of the entire device, and other features as will be addressed herein.

The present invention provides a portable exercise device which is compact in size and weight, yet is capable of providing a large easily adjusted range of resistive forces by virtue of frictional forces being applied to a rotatable surface operatively engageable with a rotatable sheave about which an exercise cord is wound. A second embodiment provides a fixed handle integrally formed with the housing containing the exercise cord and means for providing a resistance to unwinding the cord, and an exercise handle which is separable from the housing at the end remote from the fixed handle.

SUMMARY AND OBJECTS OF THE INVENTION

Thus, the present invention covers a portable exercise device to facilitate in the full and efficient exercise of the muscles of the human body, the structure of which includes, a housing assembly having a fixed handle or accessory connection means at one end and an aperture at the end opposite therefrom, a sheave or pulley assembly rotatably mounted within the housing assembly, a length of tension cord having one end fixed to the sheave, an intermediate portion windably disposed thereabout, and a free end extending through the aperture in the housing, moveable handle means fixed to the free end of the tension cord, a brake drum concentrically disposed within the sheave and operatively engageable therewith in one direction, means operatively associated with the sheave to normally and freely rotate the same in the direction reverse from the engaged direction, and means for frictionally retarding the rotation of the brake drum thereby retarding the rotation of the sheave when engaged with the brake drum to establish a resistive force to the unwinding of the tension cord.

Additionally, means for adjusting the frictional forces which retard the rotation of the brake drum, and thus the sheave, is provided in the housing so that a predetermined and calibrated resistive force can be established with respect to the tension cord.

Accordingly, it is the object of the present invention to provide a compact resistive-type exercise device which is operable for the full and efficient exercise of the muscles in the human body.

It is another object of the present invention to provide a compact portable exercise device which can be utilized to attain full extension of the muscle group being exercised and for a complete and efficient program of exercise whether the device is used independently or in conjunction with a fixed structure.

It is another object of the present invention to provide a compact portable exercise device which establishes resistance to the unwinding of an exercise cord by means of a brake drum having a concentrically disposed friction surface.

It is another object of the present invention to provide a compact portable exercise device which has an adjustment means to establish a predetermined and calibrated frictional resistance to the unwinding of an exercise cord by varying the degree of friction imposed on the friction surface.

It is yet another object of the present invention to provide a compact portable exercise device which is readily usable in any setting.

These and other objects will become apparent, as will a better understanding of the concepts underlying the present invention, by reference to the detailed description of the invention taken in conjunction with the description of the drawings.

It is imperative to bear in mind that any references to the top, bottom, side, front, rear or the like are made solely for clarity and consistency with the Figures as depicted in the drawings, and are not to be construed as suggestive of any limitations on the manner in which the portable exercise device can be used in exercising the muscles of the human body.

DESCRIPTION OF THE FIRST EMBODIMENT OF THE INVENTION

FIGS. 1-9B of the drawings show a preferred embodiment of the portable exercise device in accordance with the present invention generally designated as 10.

Consistent with the objects of the present invention, device 10 is compact in size with dimensions as small as 5.25"×3.75"×1.25". In further regard to the stated objectives, all elements of exercise device 10 are cast from an aluminum alloy, unless otherwise indicated, so as to produce an exercise device that will be light in weight and easily maneuverable.

The outer structure of the embodiment shown in FIGS. 1-9B includes a housing assembly 11 which is generally rectangular in shape and has front and rear rectangular casings **11*a* and 11*b*, respectively, which define chamber 12 when in assembled position. The castings 11*a* and 11*b* are held together by means of threaded members 13*a*–13*d*. Front rectangular shell 11*a* provides a dial opening 11*c* in the central region thereof to receive an adjustment dial 14, and rear rectangular shell 11*b* provides a spindle opening 11*d* to receive spindle 15**. More specific detail relating to this construction is set forth below.

Figure 1:
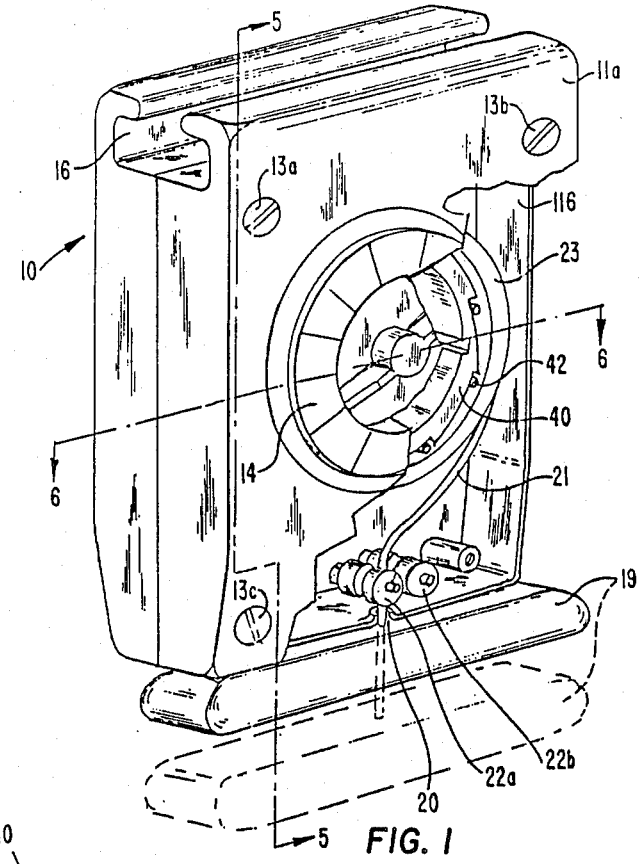
FIG. 1 is a perspective view of a side elevation of a portable exercise device in accordance with one embodiment of the present invention with a portion of the casing broken away to show the internal elements.
Figure 2:
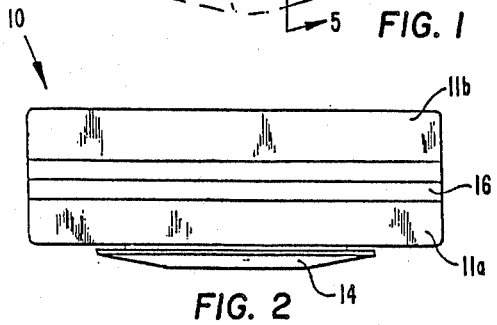
FIG. 2 is a top plan view of the portable exercise device shown in FIG. 1.
Figure 3:
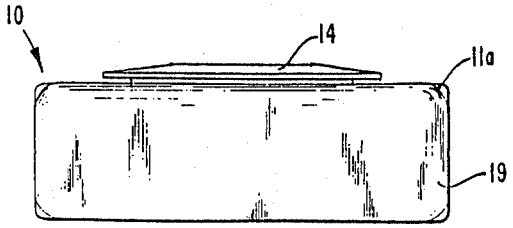
FIG. 3 is a bottom plan view of the portable exercise device shown in FIG. 1.
Figure 4:
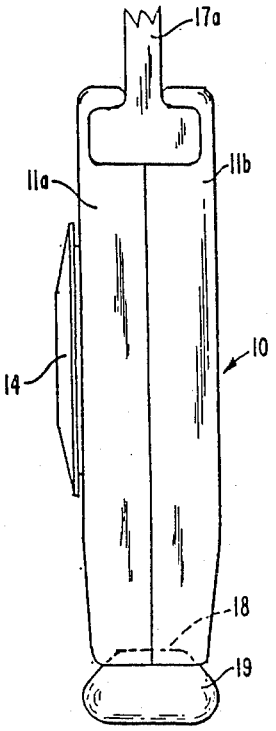
FIG. 4 is a side elevation view of the portable exercise device shown in FIG. 1 with a portion of an accessory strap connected thereto.
Figure 5:
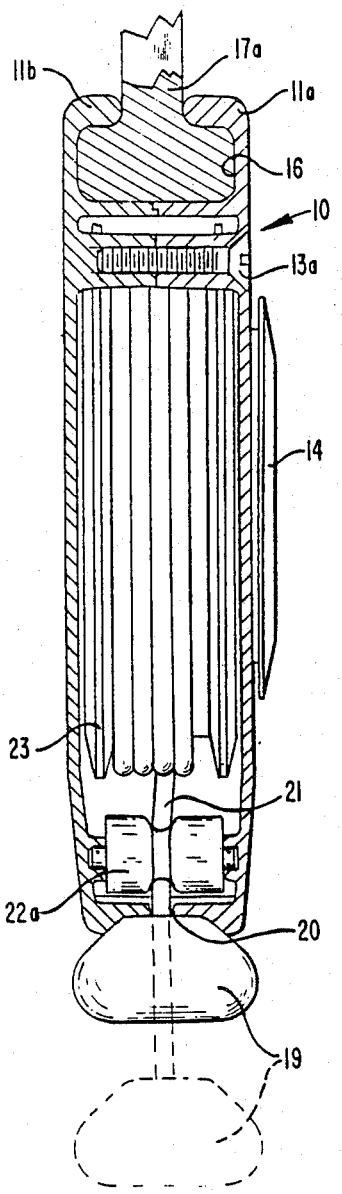
FIG. 5 is a cross-section of the portable exercise device taken on line 5—5 of FIG. 1.

As clearly shown in FIGS. 1 and 4, an inverted generally T-shaped channel 16 is formed in the top end of the housing assembly 11 so as to matingly receive an accessory strap or member 17, a fragment of which is shown in FIGS. 4 and 5, having a generally T-shaped connector **17*a*. At the end remote from the T-shaped channel 16, an inverted generally U-shaped channel 18 is formed in the bottom end of the housing assembly 11 to matingly receive a moveable exercise handle 19. In the central region of U-shaped channel 18, aperture 20 is formed to communicate with chamber 12**.

A retractable exercise cord 21, made from nylon, is fixed at its free end to the exercise handle 19 in the central region thereof and extends through aperture 20 and into chamber 12 of housing assembly 11. Directly adjacent to aperture 20 an intermediate portion of exercise cord 21 is in operative communication with rollers **22*a* and 22*b* which are rotatably secured within chamber 12. The intermediate portion of the cord 21 on the remote side of said rollers 22*a* and 22*b* is operatively wound about a sheave or pulley 23 to which the opposite end of the exercise cord 21 is connected. A cord restraint or stop 21*a* is molded from nylon to said opposite end of exercise cord 21 for connection to sheave 23 at notches 24*a* and 24*b* where cord stop 21*a* is located directly adjacent to L-shaped bracket 25**, as shown in FIG. 7.

Figure 6:
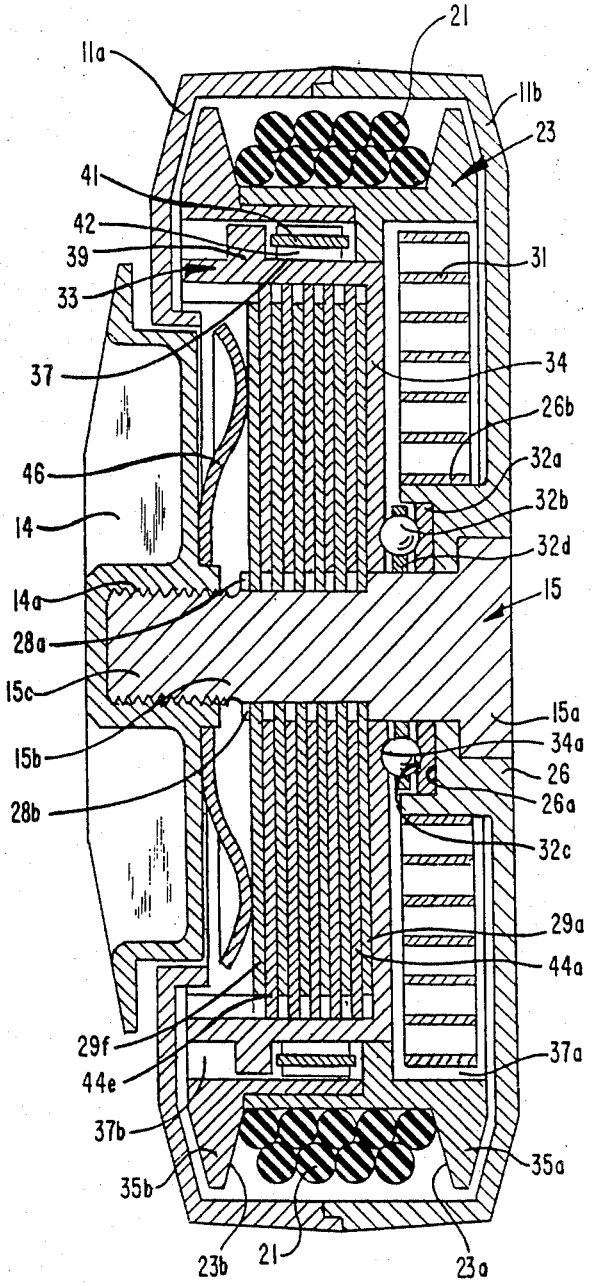
FIG. 6 is a cross-section of the portable exercise device taken on line 6—6 of FIG. 1.
Figure 7:
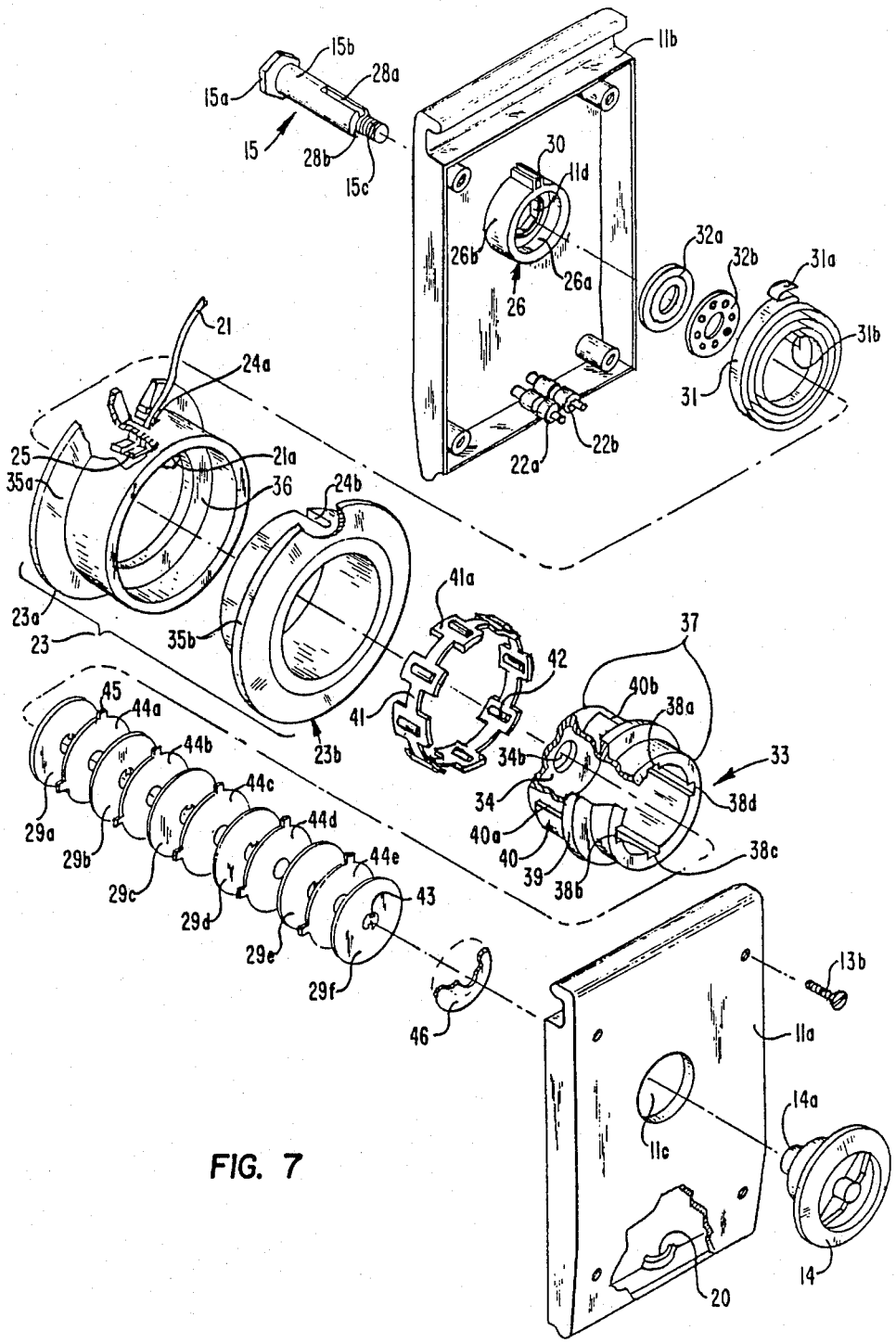
FIG. 7 is an exploded view of the internal elements and structure of the portable exercise device shown in FIG. 1.

Referring specifically to FIGS. 6 & 7, spindle 15, manufactured from a hardened steel, is shown as disposed at one end in the spindle opening **11*d* so that spindle 15 traverses chamber 12 and extends into the dial opening 11*c* for operative connection to adjustment dial 14. The annular collar 26 which defines the spindle opening 11*d* in the central region of casing 11*b* extends into chamber 12 for reenforcement, and for other purposes as will be clear from the description hereinafter. The spindle opening 11*d* is hexagonal so as to receive hexagonal head 15*a* of spindle 15 and acts to prevent spindle 15 from rotating once hexagonal head 15*a*** is in assembled position. This construction also serves to absorb the torsional load transmitted during operation.

Spindle 15 has an elongated central shaft section **15*b* which has a threaded section 15*c* continuous therewith at the end remote from the hexagonal head 15*a* of the spindle 15. Threaded section 15*c* has a reduced diameter and predetermined length for threaded engagement with female threaded section 14*a* in the adjustment dial 14. Keyways 28*a* and 28*b*, disposed for operative engagement with stators 29*a* to 29*f* as hereinafter described, are cut longitudinally along shaft 15*b* diametrically opposite one another and extend from the end of threaded section 15*c* along the longitudinal line of the larger diameter shaft section 15*b* to a predetermined distance short of the hexagonal head 15*a***.

Thrust bearing plate **32*a* of thrust bearing assembly 32 is recessed in counterbore 26*a* in annular collar 26 and is in operative communication with ball bearings 32*b* to transfer the axial load from dial 14 and brake spring 46 of device 10 to spindle 15, thus effectively internalizing the load by minimizing the compression transmitted to the housing assembly 11. Since the sheave 23 and the associated brake drum 33 will generally rotate at low speeds, a standard ball thrust bearing, as opposed to straight roller or tapered roller bearings, should suffice in carrying the axial load during operation of the portable exercise device 10**.

Ball bearings 32b are disposed in a cage 32d to facilitate in the free rotation and alignment thereof during operation. Cage 32d simply comprises two plastic rings which are snapped together about ball bearings 32b.

Optionally, a ball race 32c is concentrically formed on bearing plate 32a to further facilitate in the free movement and alignment of the ball bearings 32b.

Similarly, a ball race 34a is concentrically formed on the exterior surface of disc-shaped section 34 of brake drum 33. The bearing plate 32a, ball bearings 32b and the exterior bearing surface of the disc-shaped section 34 are preferably made of materials which are particularly resistant to frictional wear.

As shown in FIG. 6, sheave or pulley 23 is rotatably mounted over spindle 15 in housing assembly 11 which is disposed in the central region of chamber 12.

FIG. 7 of the drawings shows that sheave 23 is formed by annular sections 23a and 23b which are press fit together. These sections can be machined in the conventional manner or can be made using a pressed powder technique, depending on manufacturing requirements.

Annular section 23a includes a retaining flange 35a with notch means 24a cut therethrough to provide clearance for the innermost end of exercise cord 21. Annular section 23a further includes, an inner radial flange 36 on the inner wall thereof which, in assembled position, defines a return spring housing compartment 37a located directly below the retaining flange 35a for a spring 31, as shown in FIG. 6. Also formed on the inner wall of annular section 23a and extending into the return spring housing compartment 37a is an L-shaped bracket 25 which is operatively associated with return spring 31.

Similarly, annular section 23b, which is diametrically sized for press fit engagement within annular section 23a includes a retaining flange 35b and notch means 24b cut therethrough to provide clearance for the innermost end of the exercise cord 21. Once annular section 23b is press fit onto annular section 23a, inner radial flange 36 also serves to define a brake drum housing compartment 37b on the side opposite from the spring housing compartment 37a.

Return spring 31 is a spiral coiled spring of generally rectangular cross-section and is disposed concentrically about spindle 15 where the inside coiled end thereof fixedly engages slotted return spring catch 30 which is fixed to outer surface 26b of annular collar 26, as shown in FIG. 7. A second method of accomplishing this is to provide a slotted hole on the inside coiled end 31b of spring 31 to engage return spring catch 30 which can be made in the form of a pin. The outside free end 31a of spring 31 is generally L-shaped to matingly engage L-shaped bracket 25 thus effectively connecting spring 31 to sheave 23. It should be noted that spring 31 is partially uncoiled when assembled so that there is a constant coiling force acting on sheave 23 to ensure full retraction of cord 21 and seating of handle 19.

FIG. 6 and the exploded view in FIG. 7 further shows steel brake drum 33 which is situated within the brake drum housing compartment 37b of sheave 23 for rotation therein. Brake drum 33 includes disc-shaped section 34 and annular drum section 37 which are sized for rotation within the brake drum housing compartment 37b. Specifically, disc-shaped section 34 has a circular opening 34b sized for rotatable disposition about the unthreaded section of shaft 15b. As mentioned above, ball race 34a is concentrically formed about circular opening 34b for operative association with thrust bearing assembly 32. Annular drum section 37 extends perpendicularly from the periphery of disc-shaped section 34 and includes four rotor keyways 38a–38d disposed parallel to the longitudinal line of the spindle 15 and cut at four equidistant locations on the inner wall of annular drum section 37. Brake drum 33 also includes radial flange section 39 which is disposed about annular drum 37 and is sized for rotation within the brake drum housing compartment 37b.

A plurality of sprags 40, which are uniform in size and shape, are integrally formed about the portion of annular drum section 37 extending perpendicular to disc-shaped section 34 and as hereinafter described provides part of the means for operatively associating brake drum 33 with sheave 23. Sprags 40 are set in from disc-shaped section 34 a distance approximately equal to the width of inside radial flange 36 of sheave 23 to facilitate in positioning brake drum 33 within the brake drum housing compartment 37b, as shown in FIG. 6.

FIGS. 6 and 7 further show that each of the sprags 40 are "ramps" consisting of an inclined surface 40a and a vertical surface 40b which are shaped and sized for operative association with the rollers 42 in a roller cage 41, said rollers 42 being diametrically sized for limited rotation between annular drum section 37 and sheave 23. Roller cage 41 has the plurality of rollers 42 mounted within retaining sections 41a so that each roller 42 is associated with a single sprag 40. It is imperative to note that the diameter of rollers 42 is a function of the distance between annular drum section 37 and sheave 23, and the dimension of the vertical surface 40b on the sprags 40.

Figure 9A:
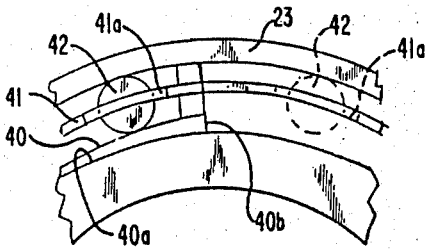
FIG. 9A is a fractional view of the sprag assembly and the roller cage showing the manner in which the brake drum is operatively engaged with the sheave upon pulling the tension cord.
Figure 9B:
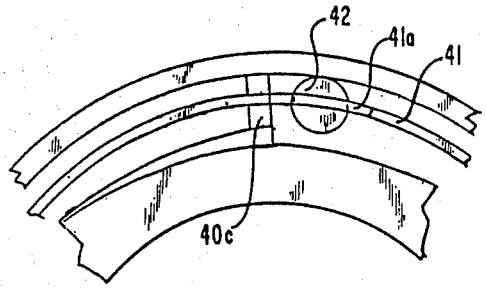
FIG. 9B is a fractional view of the sprag assembly and roller cage showing the alignment of the roller cage when the sheave is rotating independently of the brake drum.

As shown in FIGS. 9A and 9B, each sprag 40 provides a cage stop 40c which will communicate with retaining section 41a of roller cage 41 to prevent the rollers 42 from engaging vertical surfaces 40b during the free rotation of sheave 23. This is a precautionary measure taken to prevent the possibility of rollers 42 riding over vertical surface 40b and binding between said vertical surfaces 40b and sheave 23, since these vertical surfaces are minute in application and are shown in exaggerated size in the drawings only for the purpose of clarity.

Thus, when each of the retaining sections 41a are in communication with each of their associated cage stops 40c there is sufficient clearance between annular drum section 37 and sheave 23 to permit rollers 42 to rotate and thus sheave 23 is free to rotate in the counter-clockwise direction. However, when the sheave is rotated in a clockwise direction rollers 42 roll to a predetermined location on their associated inclined surfaces 40a, rollers 42 jam or bind between sprags 40 and sheave 23 thereby causing brake drum 33 to rotate with sheave 23 in the clockwise direction against the force of the braking action associated with brake drum 33.

It therefore becomes apparent that in order to establish the braking action and thus the resistance to the unwinding of exercise cord 21, sprags 40 must be positioned such that inclined surfaces 40a ascend in the clockwise direction, that is, the direction the sheave rotates when exercise cord 21 is drawn from the housing.

FIGS. 6 and 7 clearly show the braking assembly contained within brake drum 33. Thus, stators 29a to 29f are diametrically sized to fit within annular drum section 37 and have splined openings located in their respective centers. Stator splines 43 are directed inwardly towards the center of the opening and are diametrically opposite one another for operative engagement within shaft keyways 28*a* and 28*b* on shaft 15*b* to fix stators 29*a* to 29*f* with respect to shaft 15*b*. Also shown in FIG. 7 are rotors 44*a* to 44*e* which include a centrally located opening sized for free rotation about shaft 15*b*, and four equidistant rotor splines 45 extending outwardly from the periphery of the rotor for operative engagement with rotor keyways 38*a* to 38*d* of annular drum section 37 effectively fixing rotors 44*a* to 44*e* to brake drum 33 for rotation therewith.

Stators 29*a* to 29*f* and rotors 44*a* to 44*e* each provide friction surfaces and are alternately disposed over shaft 15*b* to form a stator-rotor assembly which establishes friction forces to retard the rotation of brake drum 33. It is important to note that stator 29*f* is directly adjacent to brake spring 46 so as to prevent any friction or wear on said brake spring 46 during operation of exercise device 10. Further, stator 29*a* is directly adjacent to disc-shaped section 34 which provides an additional friction surface for concentric engagement with stator 29*a* when brake drum 33 rotates.

Thus, stators 29*a* to 29*f* and rotors 44*a* to 44*e* are associated by virtue of the friction surfaces thereon which are adapted for engagement with each other in assembled position. This arrangement provides a plurality of friction surfaces providing a multiplication of the braking forces and having an aggregate area which is relatively large thereby permitting a substantial amount of braking forces to be realized as well as substantial heat dissipation during operation.

The stator-rotor package described above is particularly advantageous in that the plurality of stator 29 and rotors 44 reenforce disc-shaped section 34 of brake drum 33 and alleviate the high concentration of stress created in the region surrounding shaft 15*b* when adjustment dial 14 is forceably turned down on spindle 15.

Adjustment dial 14 is cast in aluminum and includes a cup-shaped member 14*a* with female threads therein for operative association with male threaded section 15*c* of spindle 15, as described above. Adjustment dial 14 is associated with the stator-rotor assembly by means of brake spring 46 which is free to rotate about shaft 15*b*. Brake spring 46 is a disc type spring made of a strong resilient steel alloy (spring steel). Spring 46 has a high spring constant enabling spring 46, in a compression as small as one-sixteenth of an inches to exert on the stator-rotor assembly a force of 100 pounds or more. This force will be concentrated at the point of contact between spring 46 and stator 29*f*, as shown in FIG. 6.

The pitch of the screw threads on adjustment dial 14 and threaded section 15*c* of shaft 15 are of paramount importance when considering the force required to turn dial 14. Specifically, the system will become more sensitive to precision as the pitch of the threads becomes greater, therefore making it more difficult to rotate dial 14 in order to compress spring 46.

Thus, the pitch of the threads is an important consideration especially when it is desirable to place markings on dial 14 as an indicator of the resistive force realized at the dialed position. If particularly fine threads are utilized, it may not be possible to provide such indicator markings but may become necessary to calibrate the system so that each 360° rotation of dial 14 will provide X pounds of resistive force.

It should also be noted that adjustment dial 14 not only serves to provide the axial force required to compress spring 46 but also serves to eliminate the potentially fatal deflection of spindle 15 which is realized when sheave 23 is rotating against a considerably great braking force. FIG. 6 shows the minimal clearance gap provided between the periphery of dial 14 and front rectangular casing 11*a* as at dial opening 11*c*. Thus, as spindle 15 begins to deflect this clearance gap closes and dial 14 bears against casing 11*a* to prevent any further deflection which could damage the components of device 10.

It is apparent from the above description that the elements of the portable exercise device 10 can be manufactured quite easily using simplified machining and tooling processes with little regard for exact precision.

Moreover, the assembly of these elements is simplified by the relative arrangement thereof.

The structure and arrangement of the components in the first embodiment of portable exercise device 10 as above described will be better understood from the following detailed description of the method of operation.

OPERATION OF THE FIRST EMBODIMENT OF THE INVENTION

Figure 8:
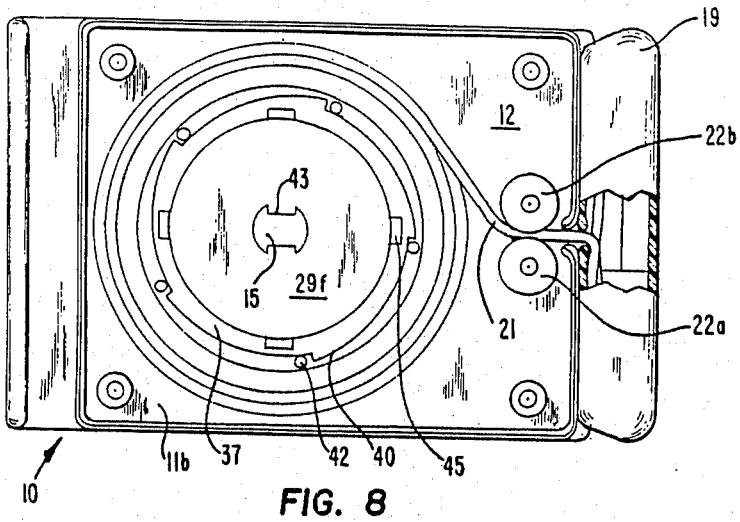
FIG. 8 is a front plan view of the portable exercise device shown in FIG. 1 with the front half of the housing removed and the tension cord in the fully retracted position.

Once exercise device 10 is assembled in accordance with the above, return spring 31, which is partially uncoiled when installed, normally exerts a recoiling force to rotate sheave 23 in the counter clockwise direction thereby drawing exercise cord 21 into housing 11 and about sheave 23, and also normally maintaining moveable exercise handle 19 within U-shaped channel 18, as shown in FIG. 8, a front view of device 10 with front rectangular shell 11*d* and adjustment dial 14 removed.

It is important to note again that upon counter-clockwise rotation of sheave 23 retaining sections 41*a* of roller cage 41 are positioned against the respective cage stops 40*c* of sprags 40 to permit sized rollers 42 to rotate freely so that sheave 23 can rotate independently of brake drum 33. This is clearly shown in FIG. 9B.

Adjustment dial 14 can now be turned clockwise to compress brake spring 46 between dial 14 and stator 29*f* thereby compressing rotors 44 and stators 29 into engagement with one another where the compressive forces acting against stators 29 and rotors 44 are a function of the stiffness of brake spring 46 and the axial movement of dial 14. As mentioned above, it may be helpful to provide radial markings on dial 14 to indicate the amount of resistive force realized by virtue of the friction forces created by the stator-rotor assembly as compressed by brake spring 46.

Following adjustment of dial 14, the operator can now choose an accessory strap or handle 17 (not fully shown) appropriate for the desired exercise movement and insert T-shaped connector 17*a* into T-shaped channel 16.

The operator then positions himself in accordance with the desired exercise movement (which may be sitting, standing, lying down, etc.) and proceeds to pull moveable exercise handle 19 out of U-shaped channel 18 and away from housing 11 thereby causing sheave 23 to rotate in the clockwise direction so as to unwind cord 21.

Figure 9:
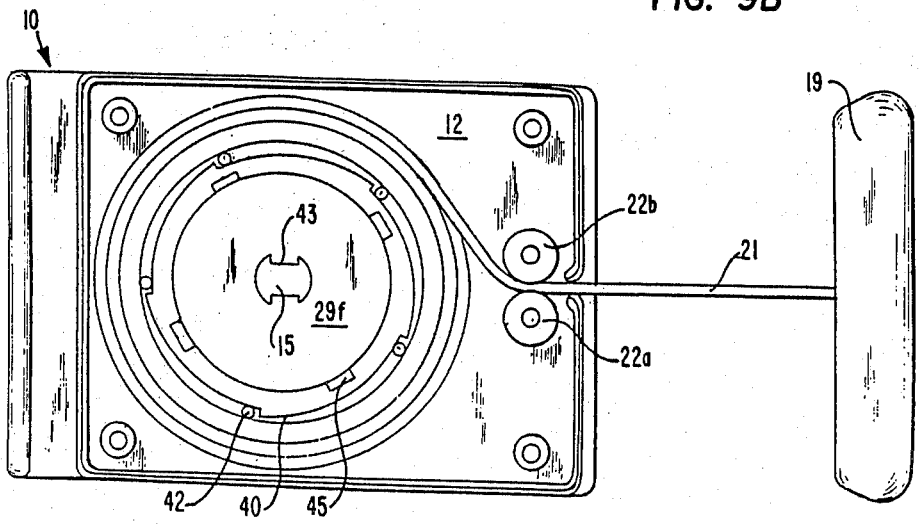
FIG. 9 is a front plan view of the portable exercise device shown in FIG. 1 with the front half of the housing removed and the tension cord in a partially drawn position.

In the initial degrees of rotation, sheave 23 causes rollers 42 to roll in the clockwise direction up the respective inclined surfaces 40*a* of sprags 40. When rollers 42 are driven to a predetermined location on the respective inclined surfaces 40*a* they bind or jam between annular drum section 37 and sheave 23 causing brake drum 33 to engage and rotate with sheave 23, as shown in FIG. 9 and more particularly in FIG. 9A. FIG. 9A shows an enlarged fractional view of one roller where the roller is shown in dotted formation as it begins to travel up the inclined surface and in solid formation as it binds between annular drum section 37 and sheave 23.

The degree of the "play" between the time sheave 23 commences rotation and the time rollers 42 bind to rotatably connect sheave 23 to annular drum section 37 is limited by appropriately shaping and sizing sprags 40 and rollers 42.

In order to continue to rotate sheave 23 so as to draw cord 21 from housing 11, the operator must pull the exercise handle 19 and cord 21 with a force sufficient to overcome the aggregate friction forces acting on and between stators 29*a* to 29*f* and rotors 44*a* to 44*e*, as well as the minimal return force created by the recoiling of return spring 31. Adjustment dial 14 can be employed to vary the force required to overcome these friction forces in accordance with the strength of the operator and the movement required by the desired exercise.

Once the exercise movement has been completed to full extension, the operator releases the pulling force to permit sheave 23 to rotate in the counter-clockwise direction by the recoiling of return spring 31. As sheave 23 begins to rotate it disengages rollers 42 from the locked positions by virtue of the recoiling force and causes them to roll down the respective inclined surfaces 40*a* where retaining section 41*a* is again in abutment with the respective cage stops 40*c* so rollers 42 freely rotate as shown in FIG. 9B. Sheave 23 can now freely rotate in the counter-clockwise direction until cord 21 is fully wound and exercise handle 19 is seated within U-shaped channel 18, as shown in FIG. 8, or until the operator pulls the exercise handle 19 for another repetition.

To complete subsequent repetitions with the same degree of resistive force, the operator follows the above procedure whereby the elements of exercise device 10 interrelate with one another as described above. If the degree of resistive force must be adjusted, the operator simply adjusts dial 14 and follows the above procedure.

DESCRIPTION OF A SECOND EMBODIMENT OF THE INVENTION

Figure 10:
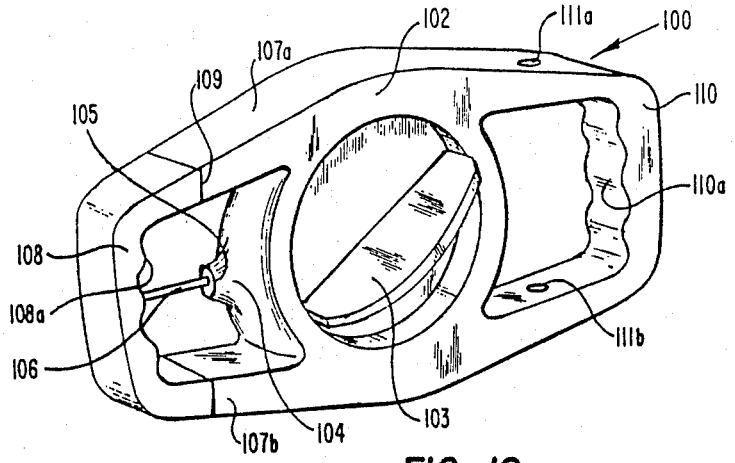
FIG. 10 is a front perspective view of a second embodiment of the outer structure of the portable exercise device in accordance with the present invention.

The second embodiment of the portable exercise device in accordance with the present invention is depicted in FIG. 10 and merely comprises an alternate outer structure for use in connection with the internal structure of the first embodiment or the internal structure of the third embodiment described hereunder.

Thus, FIG. 10 shows a portable exercise device cast in aluminum and generally designated as 100. Exercise device 100 includes a housing or casing 101 having a generally round medial section 102 with an adjustment dial 103 disposed in the center thereof for operative communication with a suitable brake spring as described above. Consistent with the objectives of the present invention, medial section 102 is compact in size with a diameter of less than four (4) inches, and dial 103 is approximately two and one-half (2.5) inches in diameter.

At the end of round medial section 102, integrally formed protuberant member 104 has an exercise cord bore or opening 105 which is disposed to receive exercise cord 106. Protuberant member 104 and cord opening 105 are centrally located with respect to handle abutment members 107*a* and 107*b* which are integrally formed with medial section 102. Handle abutment members 107 are provided for engagement, as at 109, with moveable exercise handle 108 which is fixedly connected at the center to exercise cord 106 and provides grip section 108*a*. It is advisable to provide at 109 mated structures (not shown) on abutment members 107 and moveable handle 108 whereby their engagement would be fixed to prevent handle 108 from twisting out of such engagement and permit radial movement only of handle 108.

At the end remote from moveable exercise handle 108, stationary exercise handle 110 is integrally formed with medial section 102 and also provides a grip section 110*a*. Two accessory apertures 111*a* and 111*b*, or other suitable means for connecting accessory handles or straps (not shown), are provided in the respective side members of stationary exercise handle 110.

OPERATION OF THE SECOND EMBODIMENT

The operation of the second embodiment with respect to the internal structure is identical to that in the first embodiment, and therefore reference to the above and FIGS. 8 and 9 is appropriate. However, the outer structure of the second embodiment as above described gives rise to certain more effective exercise movements once adjustment dial 103 is set to provide the calibrated resistance.

The lightweight, compact embodiment and stationary exercise handle 110 permits the operator to hold stationary exercise handle 110 in one hand, and position device 100, lengthwise or widthwise, in front of his torso, behind his neck, adjacent to either shoulder, etc., and then pull moveable handle 108 so as to exercise the desired upper body muscles. Similarly, the operator while standing or lying down can place one foot in either stationary handle 110 or moveable handle 108 and pull moveable handle 108 to exercise the muscles of the leg, back, or other lower body muscles.

The efficiency of the above exercise movements is substantially increased when the structure of the second embodiment is utilized because the operator is able to keep exercise device 100 steady by virtue of the rigid integrally formed stationary handle 110 with little or no additional effort so that the operator can concentrate on fully extending the muscles being exercised with a controlled and uniform force. A similar device having a non-rigid accessory handle or strap at one end, or being relatively heavy in weight or bulky in size could not be easily maneveured to efficiently exercise certain groups of muscles. If the device is too large and heavy, or not rigidly connected to the stationary handle, the operator must utilize muscles other than those being exercised to steady the device or must make "jerking" motions, both of which are not conducive to the efficient exercise of any muscle.

When the operator reaches full extension and releases the manual forces, exercise cord 106 is retracted within medial section 102 and rewound about the sheave by means of the return spring in the same manner as above described for the form of the invention shown in FIGS. 1 to 9B.

Thus movable handle 108 returns to casing 101 for mating engagement with abutment members 107 so that device 100 is again in position for the operator to grasp. Thus, exercise device 100 can be employed independently of any fixed structure for the performance of simple and efficient exercise movements without the hindrance of accessory straps or handles. Of course, such accessories can be connected to device 100 in accessory apertures 111*a* and 111*b* as the operator desires.

DESCRIPTION OF A THIRD EMBODIMENT OF THE INVENTION

Figure 11:
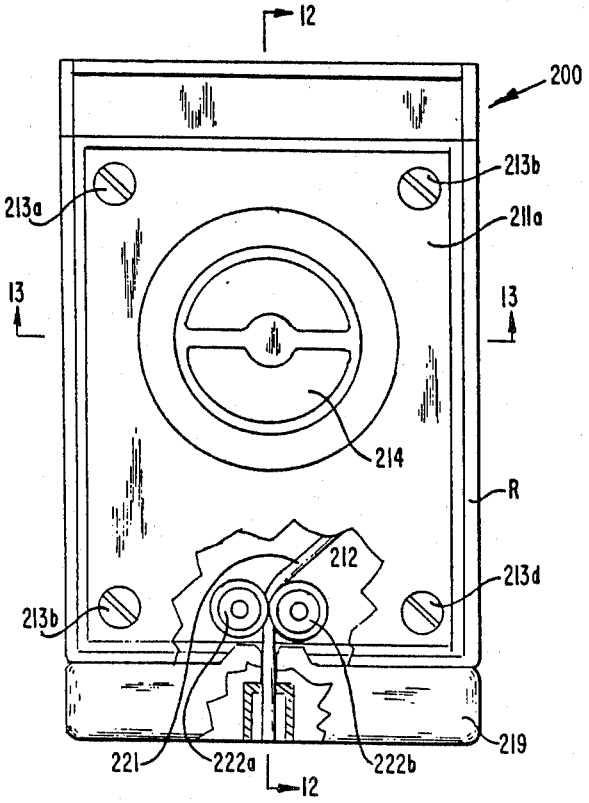
FIG. 11 is a front plan view of a third embodiment of the portable exercise device in accordance with the present invention.
Figure 12:
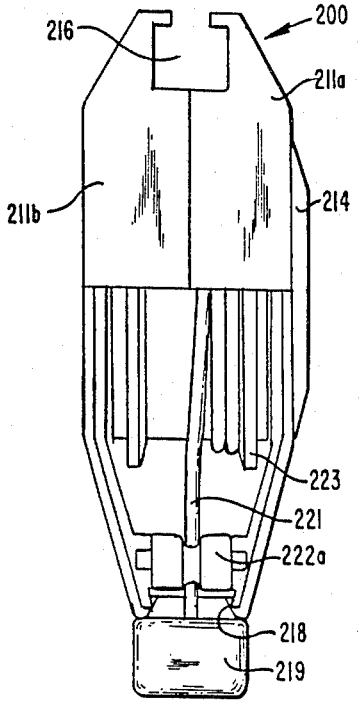
FIG. 12 is a cross-section of the third embodiment of the portable exercise device taken on line 12—12 of FIG. 11.
Figure 13:
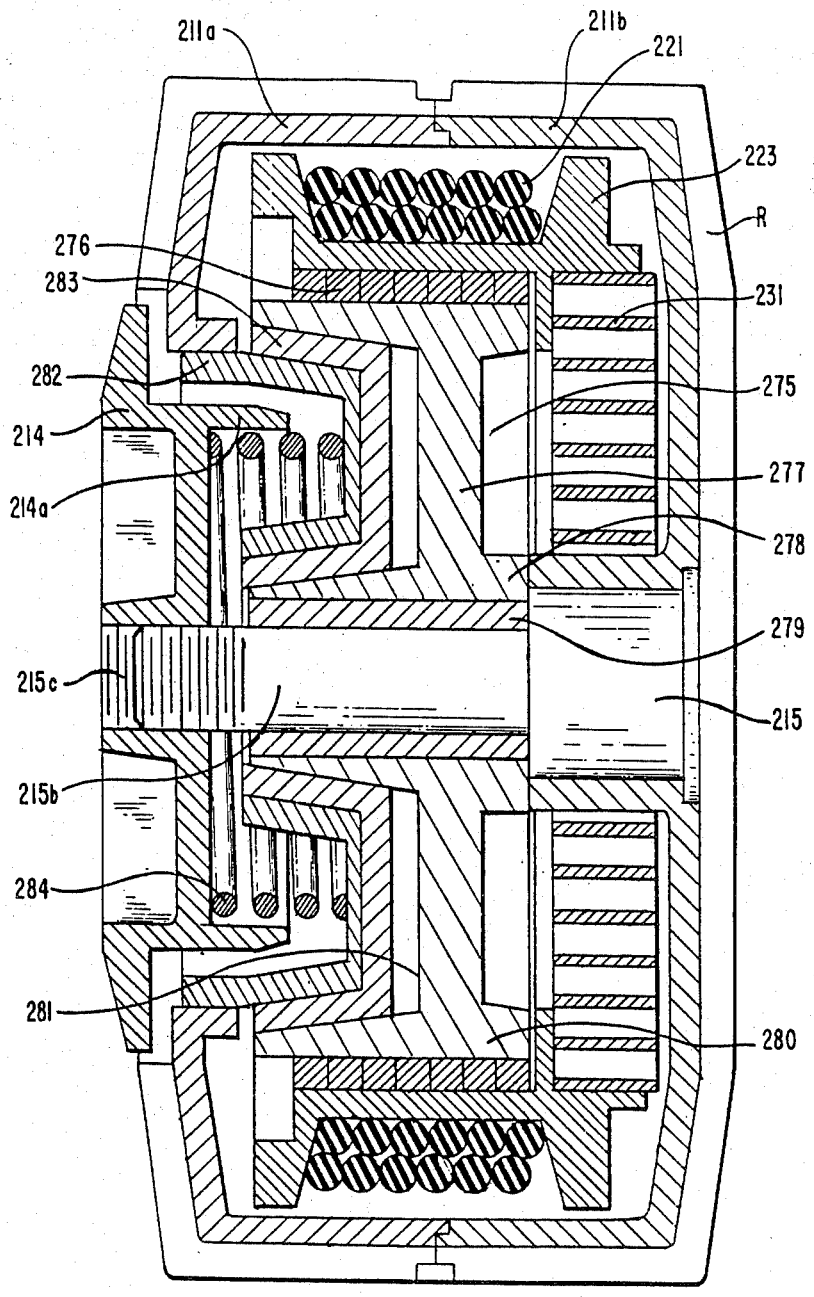
FIG. 13 is a cross-section of the third embodiment of the portable exercise device taken on line 13—13 of FIG. 11.

FIGS. 11, 12, and 13 of the drawings show a third embodiment of the portable exercise device generally designated as 200 in accordance with the present invention, which embodiment utilizes similar concepts and dimensions as those employed in the first embodiment but in conjunction with a different braking mechanism. It should also be noted that device 200 is encased in rubber R, as shown in FIG. 13, so as to protect the operator as well as any nearby items should the same be dropped.

As FIGS. 11, 12, and 13 illustrate, the external structure and a substantial portion of the internal structure of exercise device 200 are virtually identical as that of exercise device 10 as shown in FIGS. 1 to 9*a* of the first embodiment. Thus, FIG. 13 reveals that spindle 215, return spring 231, sheave 223, and the remaining structure surrounding the braking mechanism are all situated within housing assembly 211 as in the first embodiment.

The braking mechanism in this form of the invention however, does not consist of a stator-rotor assembly, but instead includes a shaped brake drum 275 which is diametrically sized for rotatable disposition within the brake drum housing compartment of sheave 223. Shaped brake drum 275 is operatively engageable with sheave 223 by means of a suitable spring overrunning clutch 276 or a sprag assembly as in the first embodiment.

Shaped brake drum 275 includes a disc-shaped section 277 with a centrally located and integrally formed cylindrical hub 278 having a cylindrical opening 278*a* therethrough which is journaled on sleeve bearing 279 situated therein. About the periphery of disc-shaped section 277 is an elongated annular flange 280 disposed for operative association with spring clutch 276 or a sprag assembly as described above.

FIG. 13 shows that in cross-section a cup-shaped braking or friction surface 281 is formed by the inner walls of the annular flange 280, disc section 277, and the cylindrical hub 278 of brake drum 275. Of course, friction surface 281, in plan view, is in the form of a circular channel or groove concentrically disposed about central shaft portion 215*b* of the spindle 215.

Operatively associated with shaped brake drum 275 and, more particularly, friction surface 281, is shaped brake shoe 282. Brake shoe 282 is also cup-shaped in cross-section and circular in plan view and includes brake pad 283 for concentric and frictional engagement with friction surface 281 of brake drum 275. However, brake shoe 282 is slidably but non-rotatably secured in the dial opening so that it does not rotate with the brake drum during operative co-action between the brake pad 283 and friction surface 281. This can be accomplished by any suitable manner including the use of a splines, as is well known in the art.

In order to adjust the frictional engagement between brake drum 282 and the friction surface 281, a helical spring 284 is positioned about the spindle 215 between the brake shoes 282 and the adjustment dial 214 which in turn is threadably mounted about the threaded end 215*c* of the spindle 215, as in the form of the invention shown in FIGS. 1 to 9B. By rotating the adjustment dial 214 clockwise or counter-clockwise the helical spring 284 will exert more or less pressure against the brake shoe 282. This in turn will cause the brake pad 283 to increase or decease frictional engagement with the friction surface 281, and in turn increase or decrease the forces acting to retard rotation of the sheeve 223 as the exercise cord 221 is pulled from the portable exercise device during use and operation thereof.

In assemblying device 200, spring clutch 276 is placed in the brake drum housing compartment, brake drum 275 is placed over shaft 215*b* and inside spring clutch 276, and brake shoe 282 together with pad 283 is matingly placed within brake drum 275. Helical brake spring 284 is then placed over shaft 215*b* and into the concentric channel of brake shoe 282. Brake spring 284 is then compressed by adjustment dial 214 until adjustment dial 214 threadedly engages shaft 215*b* thereby holding brake spring 284 in position. Spring retaining flanges 214*a* also facilitate in securing spring 284 in position.

OPERATION OF THE THIRD EMBODIMENT

Thus, when in assembled position, brake pad 283 is normally urged against friction surface 281 by virtue of compressed brake spring 284. As in the first embodiment, when spring clutch 276 engages to rotatably connect sheave 23 to brake drum 275 and cord 221 is pulled, a predetermined and calibrated frictional force is established between brake pad 283 and friction surface 282 as the sheave 223 rotates. During operation and use of the portable exercising device 200, this effectively creates a predetermined and calibrated resistive force on cord 221, which can be adjusted as the user may desire with dial 214.

After exercise cord 221 is withdrawn from the housing 211, if the manual forces acting on the handle 219 are reduced, the exercise cord 221 will be returned to the housing under the action of the recoil spring 231 as in the operation of the first form of the invention above described.

It therefore becomes apparent that this third embodiment is operated in precisely the same manner as described above with respect to the first embodiment with the exception of a differently structured braking mechanism. Again, a relatively large surface area works to provide greater adjustable resistive forces as well as a greater degree of heat dissipation than those in the prior art.

DESCRIPTION OF A FOURTH EMBODIMENT OF THE INVENTION

Figure 15:
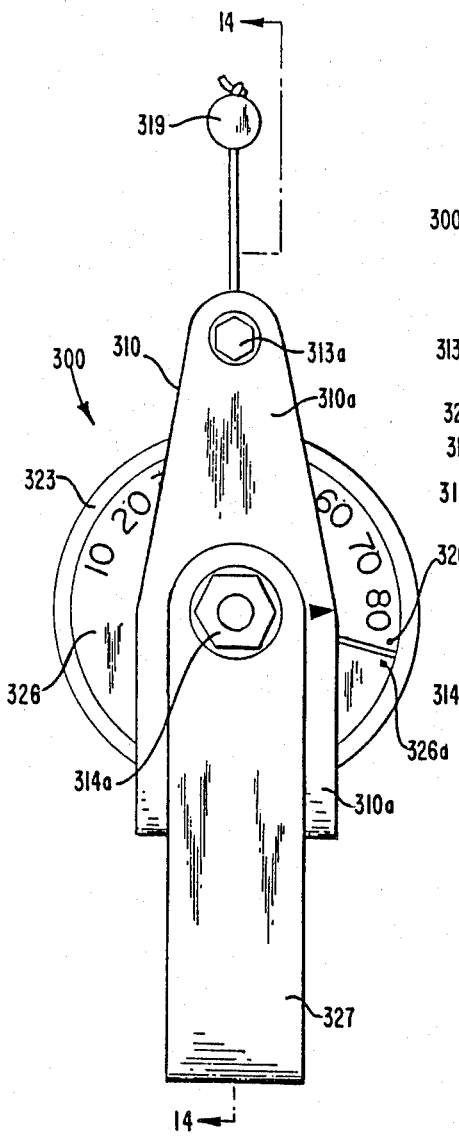
FIG. 15 is a left side view of the portable exercise device shown in FIG. 14.
Figure 14:
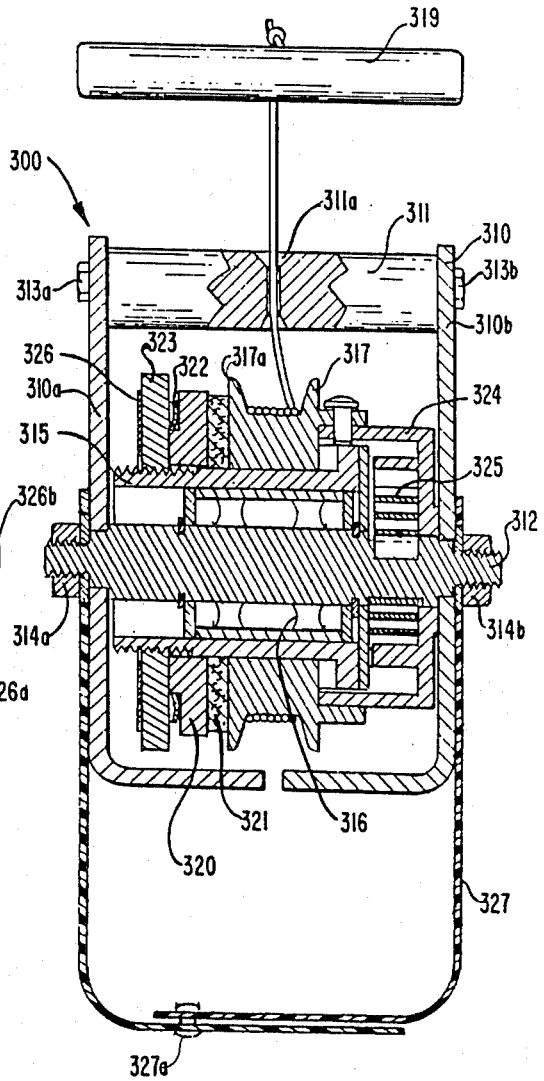
FIG. 14 is a vertical cross-section through a fourth embodiment of a portable exercise machine in accordance with the present invention.

Referring again to the drawings, FIGS. 14 and 15 show a fourth embodiment of a portable exercising assembly generally designated as 300 in accordance with the present invention.

This form of the invention differs from the other embodiments as above described in several respects, the most important of which is that the braking assembly rotates with sheave 317 in the counter-clockwise direction and a one-way spring clutch 316 operates to fix the braking assembly to a fixed shaft 312 upon clockwise rotation of said sheave 317.

Thus, FIGS. 14 and 15 show a housing 310 which includes right side plate 310*a* and left side plate 310*b*. Side plates 310*a* and 310*b* are positioned relative to one another by virtue of transverse spacer 311 and fixed transverse shaft 312. Transverse spacer 311 provides threaded longitudinal bores at each respective end for threaded communication with threaded members 313*a* and 313*b*, which secure transverse spacer 311 between right side plate 310*a* and left side plate 310*b*. Transverse spacer 311 also includes a cord aperture 311*a* for exercise cord 18 which is fixed to exercise handle 319 for use by the operator. Fixed transverse shaft 312 is threaded at each respective end for receiving female threaded nuts 314*a* and 314*b*, which secure fixed transverse shaft 312 between the respective side plates 310*a* and 310*b* in a non-rotatable fashion.

A fixed handle 327 is fixed to the portable exercise device 300 on the threaded portion of shaft 312 between the housing side plates and threaded nuts 314, and extends below the housing 310 for connection to a fixed structure or direct use by the operator. The width at the lower end ofc fixed handle 327 can be adjusted by means of adjustment member 327*a*, as is clearly shown in FIG. 14.

A cylindrical shaft housing assembly 315 is disposed about fixed shaft 312 for uni-directional (counter-clockwise) rotation thereabout. A one-way spring clutch shown as at 316 or a sprag assembly as described in the earlier embodiments is provided between shaft housing assembly 315 and fixed shaft 312 for operatively locking shaft housing assembly 315 to fixed shaft 312 upon clockwise rotation thereof and to permit the free counter-clockwise rotation thereof.

Sheave or pulley 317 is rotatably mounted about shaft housing assembly 315 for spring actuated counter-clockwise rotation therewith and for clockwise rotation against the friction forces established by the braking mechanism which is fixed to shaft housing assembly 315, as shall be described below.

An exercise or tension cord 318 is windably disposed about sheave 317, with the free end thereof being connected to a moveable exercise handle 319 as in the previous embodiments. Sheave 317 further includes a concentrically disposed friction surface as at 317*a* for frictional engagement with friction or brake pad 321 of the braking mechanism.

The braking mechanism of portable exercise device 300 is comprised of a brake pressure plate 320 on which is fixed a friction or brake pad 321 for concentric and frictional engagement with concentric friction surface 317*a* of sheave 317, a disc spring 322 and an adjustable dial plate 323. Brake pressure plate 320 is fixed to shaft housing assembly 315 by any suitable means, for example a keyway assembly. Directly adjacent to the brake pressure plate 320 is the disc spring 322 and the adjustable dial plate 323 which is threadedly mounted on threaded portion 315*a* of shaft housing 315 for longitudinal adjustment thereon. Preferably, adjustment dial plate 323 is knurled on the periphery thereof to facilitate in the longitudinal adjustment thereof, however it can be geared at said periphery with a mated gear member mounted in left side plate 310*a*.

As shown in FIG. 15, a calibration disc 326 is provided between left side plate 310*a* and adjustable dial plate 323, and is marked to indicate the calibrated resistive force established by the braking mechanism. Calibration disc 326 is removably fixed to dial plate 323 by means of set screws 326*a* and 326*b*. This structure is important because it permits the recalibration of the device when brake pad 321 wears under normal use. This is accomplished by backing off set screws 326*a* and 326*b*, moving pressure plate 320 towards sheave 317 until sheave 317 cannot be rotated, and then rotating calibration disc 326 so that the mark "80" is aligned with the point of the arrow on side plate 310*a*. Note that the mark "80" may not necessarily indicate pounds but may indicate the first point of resistance that a particular operator cannot overcome.

A return spring mount 324 for operative association with sheave 317 is rotatably mounted on fixed shaft 312 between shaft housing assembly 315 and right side plate 310*b*. Return spring 325, a relatively stiff spiral coiled spring of rectangular cross-section, is disposed within spring mount 324 to normally urge sheave 317 in the counter-clockwise direction, as in the earlier embodiments.

Thus, it is apparent that the objectives of the present invention are served by this embodiment because the structure described above is compact and lightweight yet capable of providing a wide range of resistive forces.

The structure of this fourth embodiment of the portable exercise device will be better understood from the following description of the method of operation.

OPERATION OF THE FOURTH EMBODIMENT OF THE INVENTION

The operator of portable exercise device 300 will operate the same in a manner identical to the operation of the previous embodiments with the exception of adjusting the resistive force.

Thus, the operator will grip the knurled periphery of adjustment dial plate 323 and rotate the same in the clockwise direction to further compress disc spring 322 against brake pressure plate 320 so as to adjust the friction forces established between the concentric friction surface 317*a* of sheave 317 and friction or brake pad 321.

Once the operator has "dialed" the desired resistive force as indicated on left side plate 310*a* and adjustable dial plate 323, he will position himself appropriately for the desired exercise. When the operator pulls movable exercise handle 319 so as to unwind exercise cord 318 from about sheave 317, one-way spring clutch 316 will engage fixed transverse shaft 312 effectively locking shaft housing assembly 315 to said shaft 312. Thus, brake pressure plate 320 and brake pad 321 become fixed in relation to shaft 312 while sheave 317 is rotatable against the friction forces established between brake pad 321 and concentric friction surface 317*a*.

After the operator has completed the full extension of the muscle being exercised he will release the pulling force from movable exercise handle 319 thereby causing one-way spring clutch 316 to disengage from fixed shaft 312 to permit the free counter-clockwise rotation of shaft housing assembly 315 with sheave 317 by virtue of return spring 325. Of course, this procedure is repeated until the operator has appropriately fatigued the muscles being exercised.

Thus, several embodiments of a compact portable exercise device to facilitate in the full and efficient exercise of any group of muscles has been described.

It will be understood that the present invention is not to be construed as limited to the specific structure or embodiments shown and described heretofore but that the same may be modified within the spirit and scope of the present invention as defined by the claims which follow.

What is claimed is:

1. A portable exercise device comprising, a. a housing assembly;

b. sheave means rotatably mounted in said housing assembly;

c. cord means removably wound about said sheave means and having, a free end extending from said housing assembly;

d. handle means connected to the free end of the cord means to enable the cord means to be unwound from said sheave means;

e. means connected to the sheave means for normally maintaining the cord means in the wound position and for rewinding the cord means on the sheave means during use of the portable exercising device;

f. brake assembly means in said housing assembly mounted in alignment with and concentrically within said sheave means for rotatable coaction with said sheave means during unwinding of said cord means, g. means in said brake assembly defining a friction surface operatively connectable to the respective sheave means and said brake assembly means acting upon the inner surface of said sheave means for restricting the rotational movement of said sheave means with respect to said brake assembly means during unwinding of said cord means;

h. said brake assembly means including, adjustable brake means rotatably disposed for establishing the friction forces exerted with said friction surface means; and i. means connected to said adjustable brake means to adjust the forces exerted by said friction surface means during the unidirectional unwinding of the cord means for the housing assembly.

2. In a portable exercise device as claimed in claim 1 including, an intermediate means for operatively engaging the brake assembly means with said sheave means during the unwinding of said cord means.

3. In the portable exercise device as claimed in claim 1 including accessory connection menas on said housing assembly remote from the handle means to be positioned during use of the portable exercise device.

4. In the portable exercise device as claimed in claim 1 wherein the handle means is formed as a separable element of the housing assembly.

5. In the portable exercise device as claimed in claim 1 wherein, a. said housing has an aperture therein, and b. means on the sheave means for connecting one end of the cord means in the housing assembly, an intermediate portion of said cord means operatively wound about the sheave means, and the free end of the cord means disposed to extend through the aperture in said housing assembly.

6. In the portable exercise device as claimed in claim 1 wherein the means for bringing said adjustable brake means into engagement with the friction surface means includes, a. resilient means disposed to engage the adjustable brake means, and b. an adjustment dial on said housing assembly operatively associated with the resilient means to adjust the friction forces exerted by the coaction of the adjustable brake means and the friction surface means.

7. In the portable exercise device as claimed in claim 1 including, sprag means disposed between the brake assembly means and the sheave means to connect the brake assembly means when the cord means is being unwound and to release the brake assembly means from connection with the sheave means when the cord means is being rewound.

8. In the portable exercise device as claimed in claim 7 wherein, said sprag means includes, a. spaced ramp means disposed on the outer face of the brake assembly means, b. annular cage means disposed about the outer face of the brake assembly means, and c. said cage means having, a plurality of roller means equal in number to the spaced ramp means on the outer surface of the brake assembly means.

9. In the portable exercise device as claimed in claim 1 including, a. a non-rotatable spindle connected at one end to said housing assembly and threaded at the end remote therefrom, b. said sheave means rotatably mounted on said spindle, c. said brake assembly means including, a brake drum means rotatably mounted about said spindle, d. said means defining a friction surface including stator means fixedly connected to said spindle, e. said adjustable brake means including, rotor means fixedly connected to said brake drum means and disposed for operative engagement with the stator means during operation of the portable exercise device.

10. In the portable exercise device as claimed in claim 9 wherein the means for urging said adjustable brake means into engagement with said friction surface means includes, a. resilient means disposed to engage the adjustable brake means, and b. an adjustment dial threadably mounted on said spindle means and movable for adjusting the forces exerted by said resilient means on said rotor means thereby providing a predetermined resistive force to the unwinding of said cord means.

* * * * *